US008171575B2

(12) United States Patent
Oh

(10) Patent No.: US 8,171,575 B2
(45) Date of Patent: May 8, 2012

(54) BIDET HAVING VIBRATOR

(76) Inventor: Young-Kuk Oh, Seoul (KR)

( * ) Notice: Subject to any disclaimer, the term of this patent is extended or adjusted under 35 U.S.C. 154(b) by 896 days.

(21) Appl. No.: 12/159,692

(22) PCT Filed: Dec. 21, 2006

(86) PCT No.: PCT/KR2006/005639

§ 371 (c)(1),
(2), (4) Date: Jun. 30, 2008

(87) PCT Pub. No.: WO2007/075002

PCT Pub. Date: Jul. 5, 2007

(65) Prior Publication Data

US 2009/0025133 A1 Jan. 29, 2009

(30) Foreign Application Priority Data

Dec. 28, 2005 (KR) ..... 20-2005-0036621 U

(51) Int. Cl.
*A61H 35/00* (2006.01)

(52) U.S. Cl. ..... 4/448; 601/160

(58) Field of Classification Search ..... 4/448, 443; 601/154, 160; 604/279, 22, 39
See application file for complete search history.

(56) References Cited

U.S. PATENT DOCUMENTS

| | | | | |
|---|---|---|---|---|
| 1,594,636 | A * | 8/1926 | Smith | 601/154 |
| 2,369,881 | A * | 2/1945 | Berns et al. | 601/154 |
| 2,905,171 | A * | 9/1959 | De Crescenzo | 601/105 |
| 3,504,665 | A * | 4/1970 | Bakunin et al. | 601/71 |
| 3,720,204 | A * | 3/1973 | Wojtowicz | 601/148 |
| 3,754,548 | A * | 8/1973 | McGrath | 601/154 |
| 3,847,150 | A * | 11/1974 | Scheuermann | 604/84 |
| 3,910,266 | A * | 10/1975 | Kawase | 601/160 |
| 5,081,985 | A * | 1/1992 | Borodulin et al. | 601/1 |
| 5,097,540 | A * | 3/1992 | Lovitt | 4/443 |
| 5,187,827 | A * | 2/1993 | Wei | 15/22.1 |
| 6,730,051 | B2 * | 5/2004 | Lin | 601/112 |
| 7,458,944 | B2 * | 12/2008 | Liste et al. | 601/17 |

FOREIGN PATENT DOCUMENTS

| | | |
|---|---|---|
| EP | 0543518 | 5/1993 |
| JP | 2002-253994 | 9/2002 |
| JP | 3095155 U | 7/2003 |
| KR | 200223919 | 5/2001 |
| KR | 20-0377073 Y1 | 2/2005 |
| KR | 200377073 | 2/2005 |
| KR | 20-0398076 Y1 | 10/2005 |
| KR | 200398076 | 10/2005 |

* cited by examiner

*Primary Examiner* — Korie Chan
(74) *Attorney, Agent, or Firm* — Park & Associates IP Law, P.C.

(57) ABSTRACT

A beauty-care bidet includes an introduction hose for introducing washing water, a water purifier connected to the introduction hose for purifying the washing water introduced through the introduction hose, a head separably coupled to the water purifier and having an open tip end portion communicating with the water purifier, a control valve for cutting off the washing water supplied to the open tip end portion of the head or for regulating a pressure of the washing water, a tip end operating unit detachably attached to the open tip end portion of the head, and a vibrator mounted to the head in such a way that the vibrator can be operatively connected to the tip end operating unit. The tip end operating unit is a bidet-washing insertion device that can be inserted into an intestine or a vagina of a user.

9 Claims, 7 Drawing Sheets

[Fig. 1]
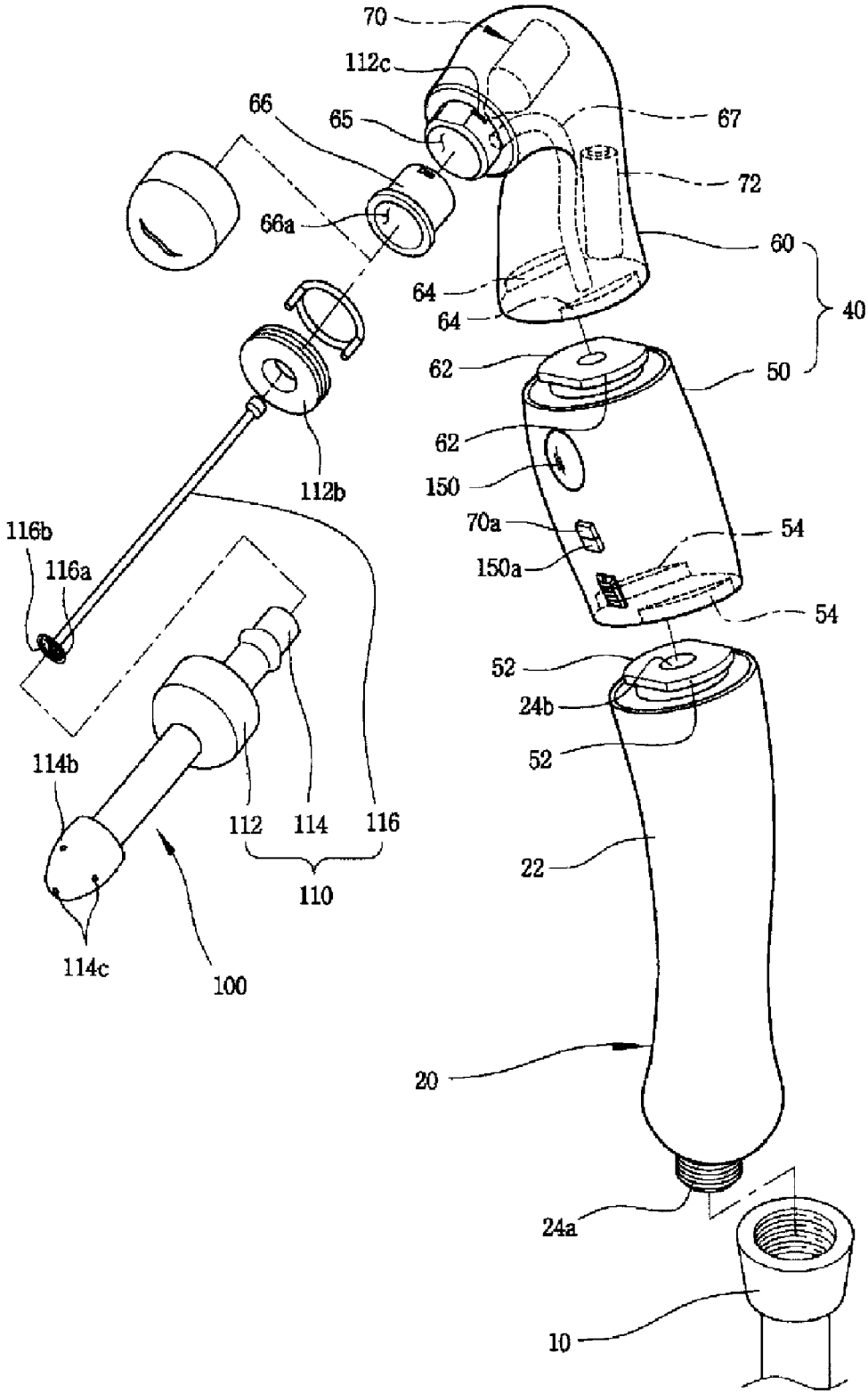

[Fig. 2]
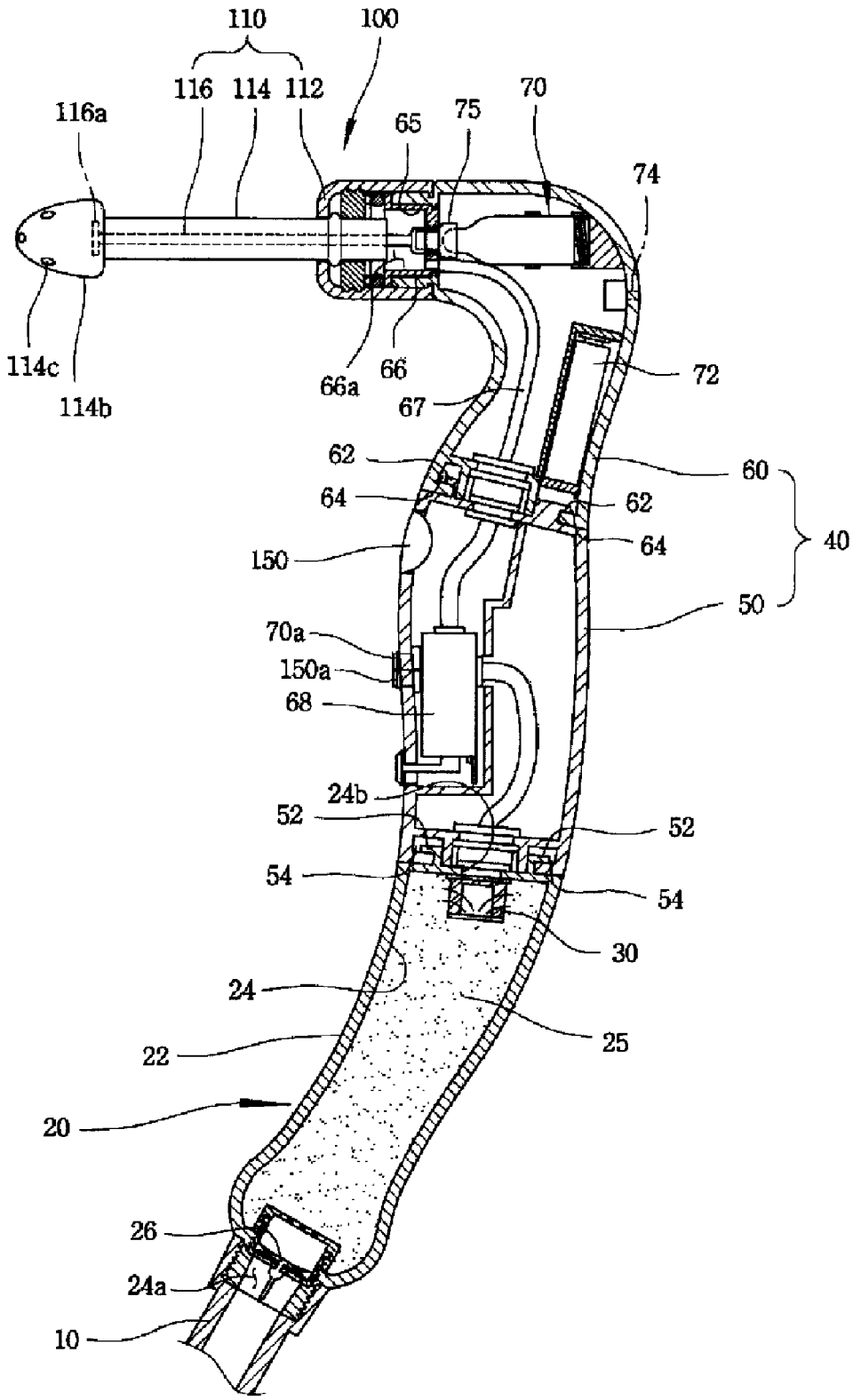

[Fig. 3]
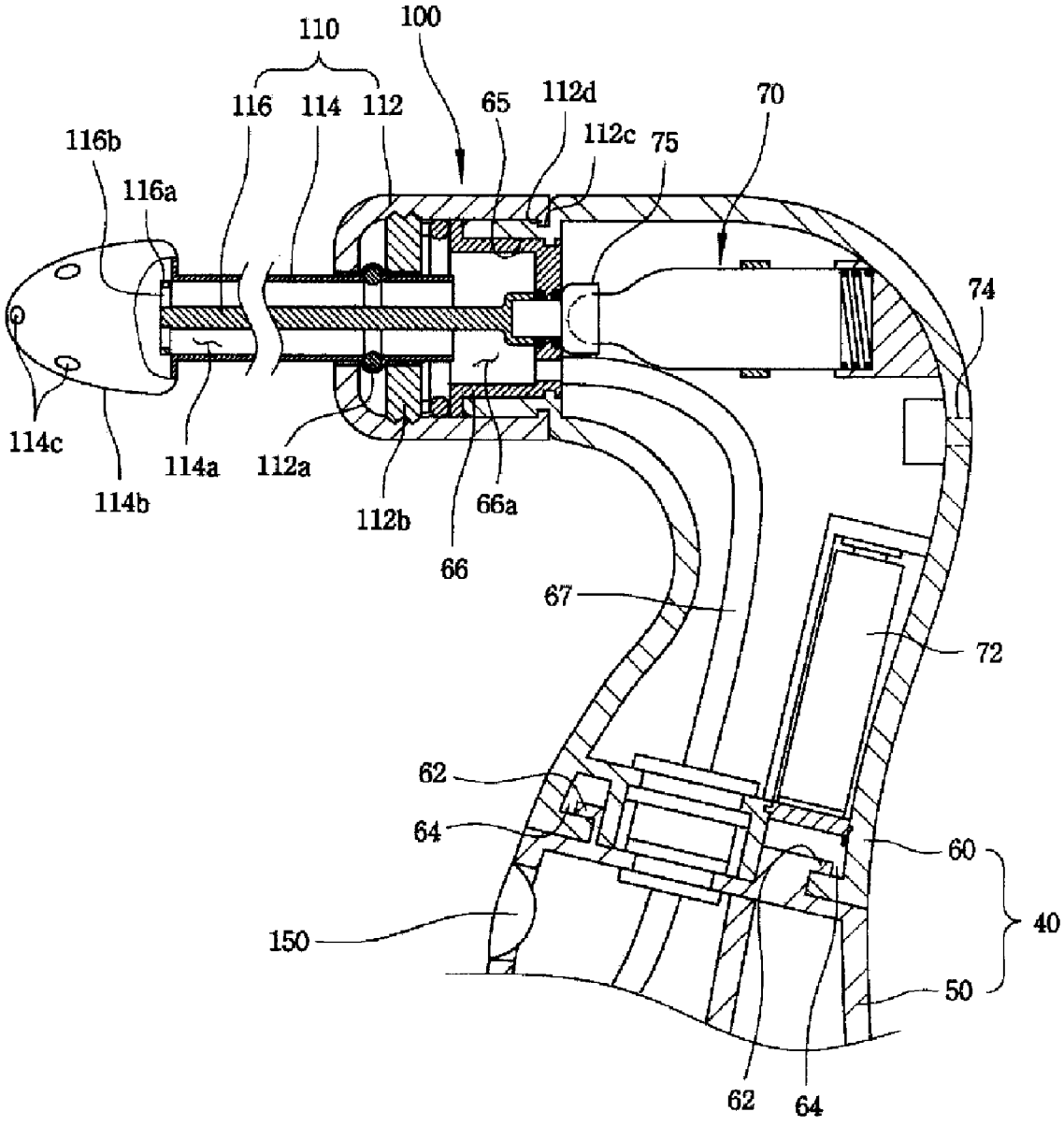

[Fig. 4]
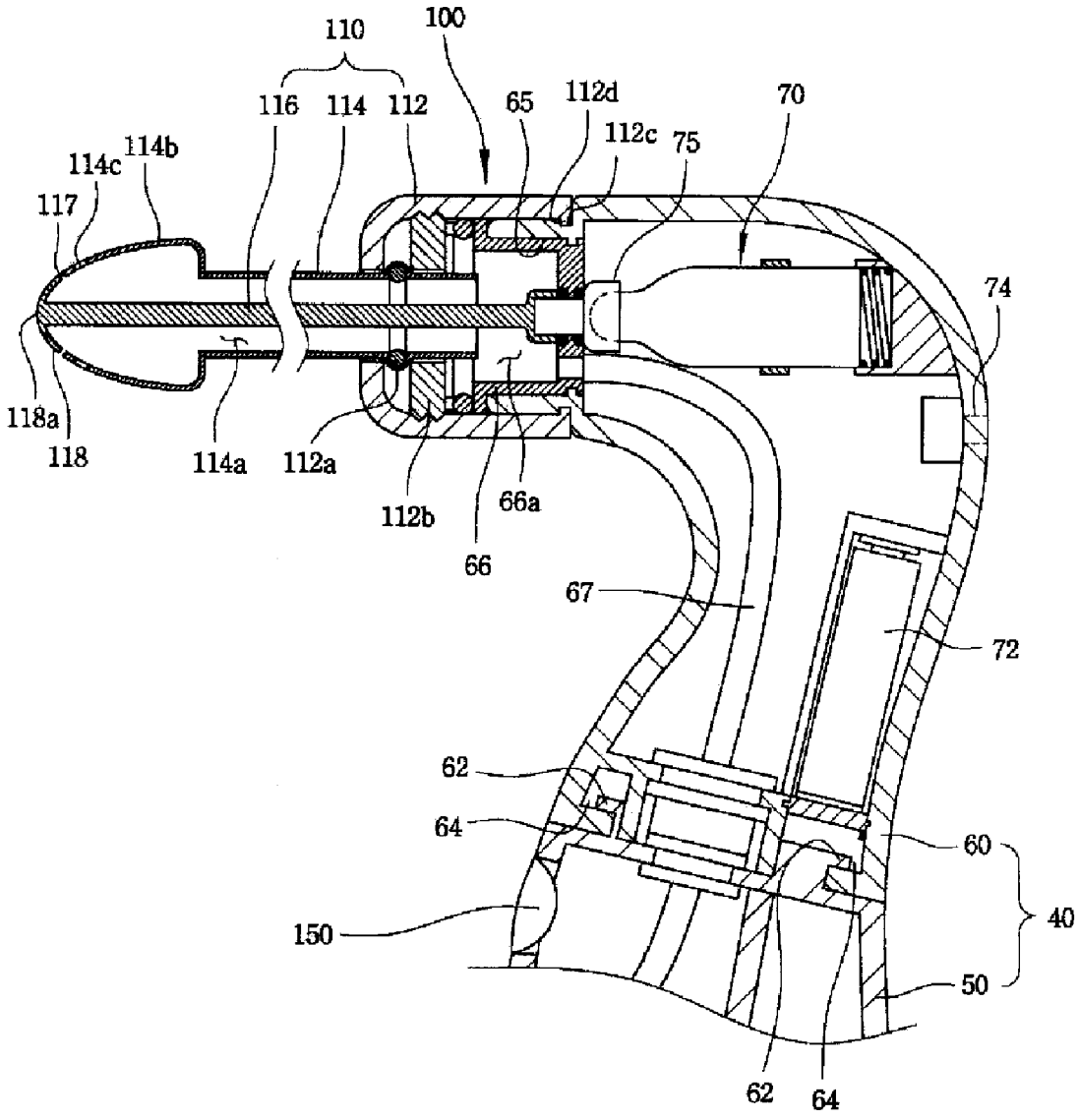

[Fig. 5]
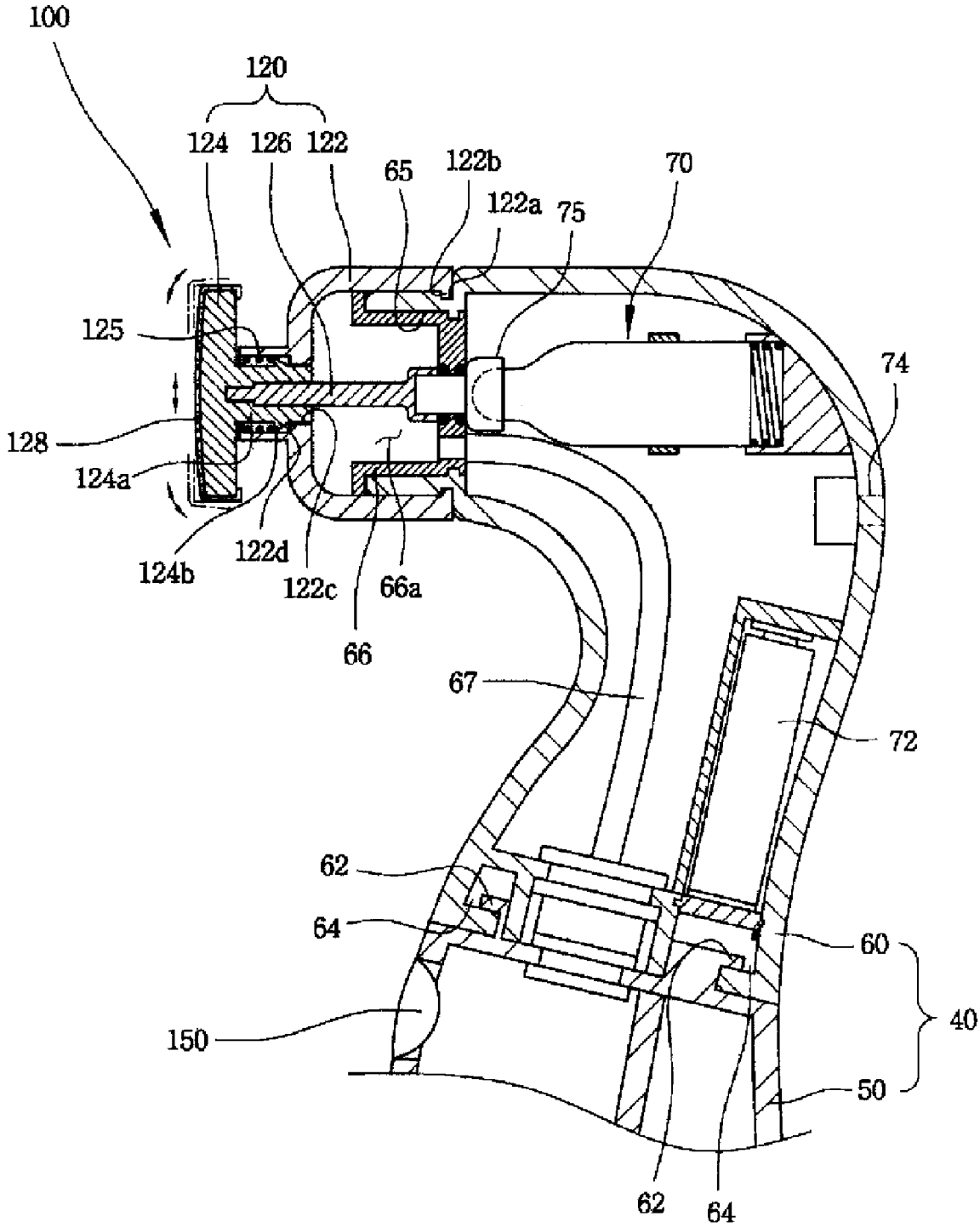

[Fig. 6]
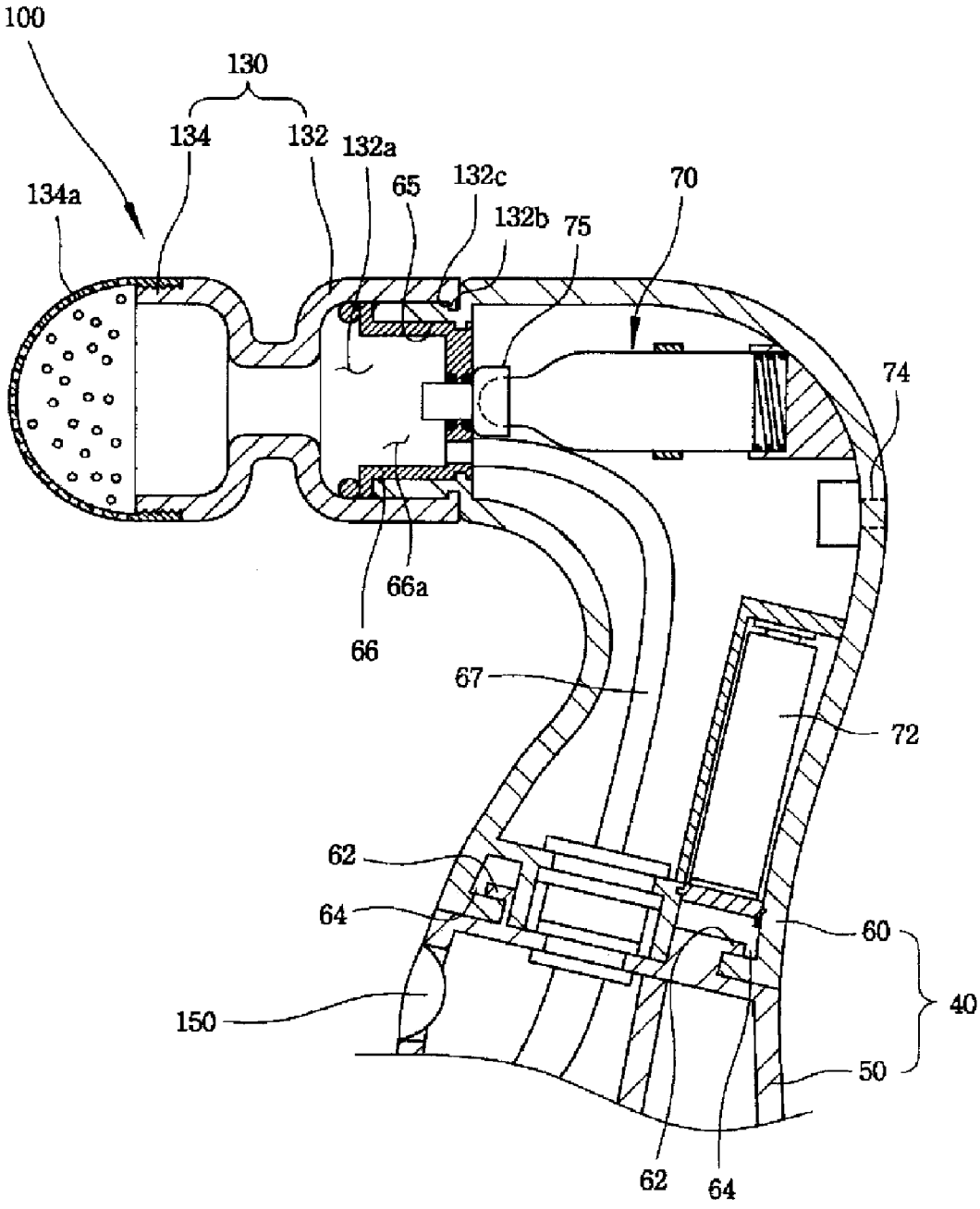

[Fig. 7]
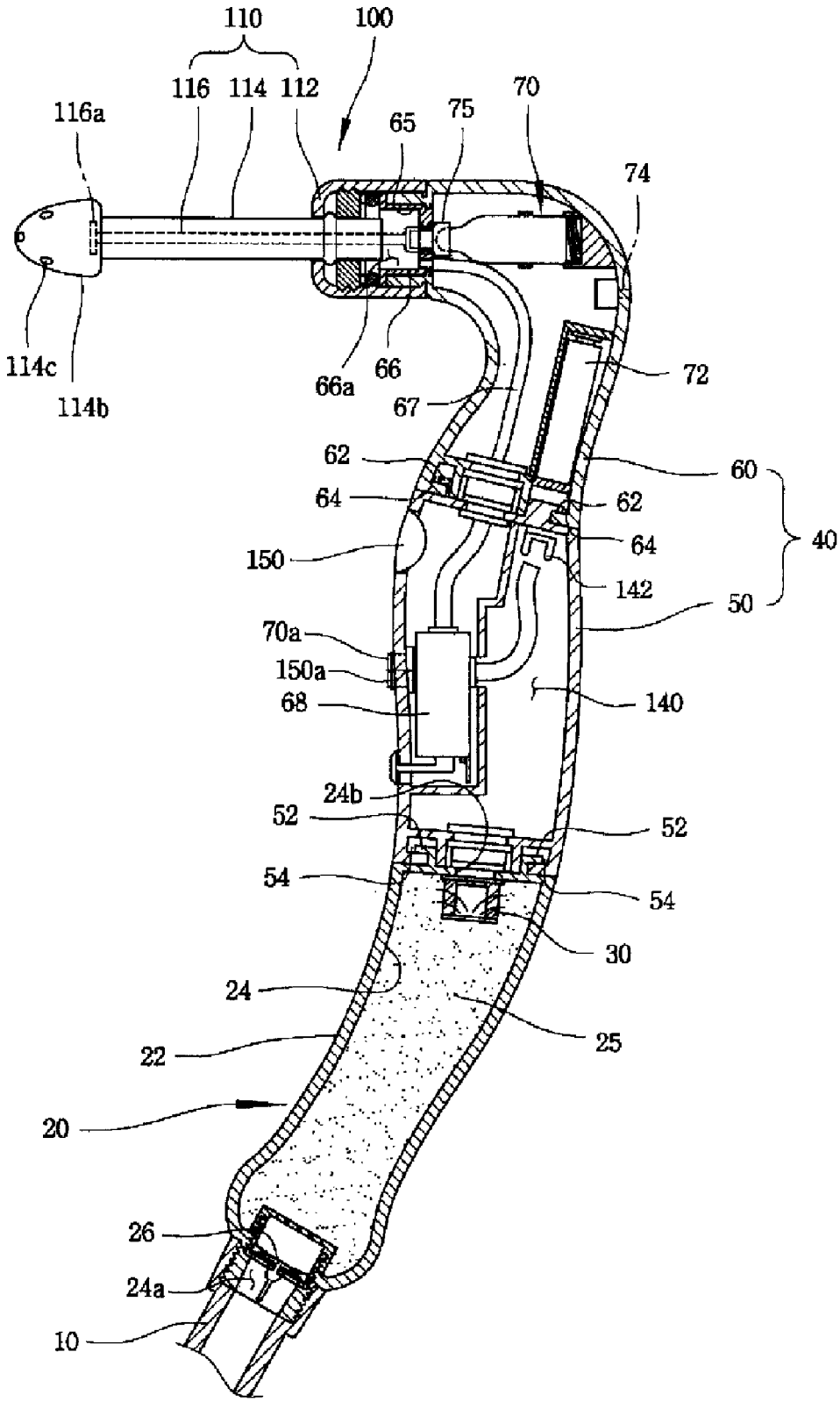

BIDET HAVING VIBRATOR

TECHNICAL FIELD

The present invention relates to a beauty-care bidet having a vibrator and, more specifically, to a beauty-care bidet with a vibrator that can be inserted into an intestine or a vagina to wash the inner part thereof, while capable of being used for a beauty care purpose.

BACKGROUND ART

In recent years, various kinds of devices have been developed for body-washing use and beauty-care use, examples of which include a bidet and a vibratory massage device. The bidet is mounted on the rear side of a toilet bowl and used to wash a posterior part, i.e., an anus. The vibratory massage device is provided with a built-in vibrator and adapted to apply vibration to a skin or a specified part of a human body, thereby stimulating and massaging the skin or removing corneous tissues.

However, a conventional bidet is installed on a toilet bowl and has a drawback in that it is designed to merely wash an anus. In particular, the bidet is of the structure that sprays water (hereinafter called "washing water") from below the anus and, therefore, use of the bidet is limited to washing an exposed part. No water is supplied into an intestine or a vagina, which needs to be kept clean indeed. Thus, it is impossible for the conventional bidet to wash the inside of the intestine or the vagina. Furthermore, the conventional bidet is designed to use a tap water as it is and therefore suffers from a reduced cleanliness, which leads to a decrease in cleaning efficiency On the other hand, the conventional vibratory massage device is dedicated to beauty care and finds its use in a limited application. Therefore, the conventional vibratory massage device fails to give a consumer a strong impulse to purchase the same.

DISCLOSURE OF INVENTION

Technical Problem

In view of the afore-mentioned problems inherent in the prior art, it is an object of the present invention to provide a beauty-care bidet with a vibrator that can be handheld by a user and can be brought into close proximity to a target bodily part to wash the latter, thus enjoying an ability to wash any part of a human body.

Another object of the present invention is to provide a beauty-care bidet with a vibrator that can be inserted into an intestine or a vagina to wash the inside thereof and can increase a washing efficiency by using a structure for vibrating washing water.

A further object of the present invention is to provide a beauty-care bidet with a vibrator that has a function of massaging a skin of a human body and a function of washing the skin in combination, thereby enjoying a capability of washing and massaging a broad area of the human body and stimulating a consumer's buying desire for the device.

Technical Solution

With these objects in view, the present invention provides a beauty-care bidet including: an introduction hose for introducing washing water; a water purifier connected to the introduction hose for purifying the washing water introduced through the introduction hose; a head separably coupled to the water purifier and having an open tip end portion communicating with the water purifier; a control valve for cutting off the washing water supplied to the open tip end portion of the head or for regulating a pressure of the washing water; a tip end operating unit detachably attached to the open tip end portion of the head; and a vibrator mounted to the head in such a way that the vibrator can be operatively connected to the tip end operating unit.

Preferably, the tip end operating unit includes a bidet-washing insertion device, the bidet-washing insertion device including: a main body detachably attached to the open tip end portion of the head; an antimicrobial silicon hose extending frontward from the main body for insertion into an intestine or a vagina of a user, the silicon hose having a flow passage communicating with the open tip end portion of the head and a nozzle head for spraying the washing water introduced into the flow passage; and a vibration bar fitted into the antimicrobial silicon hose to transfer vibration of the vibrator to the antimicrobial silicon hose.

The tip end operating unit may include a massage device, the massage device including: a main body detachably attached to the open tip end portion of the head; a vibration head movably provided in a front portion of the main body; and a vibration bar for transferring vibration of the vibrator to the vibration head.

The tip end operating unit may include a shower device, the shower device including: a main body detachably attached to the open tip end portion of the head and having a flow passage communicating with the open tip end portion; a vibration transfer member for transferring vibration of the vibrator to the washing water in the flow passage; and a spray head provided in the main body for spraying the washing water introduced into the flow passage.

A sterilizing chamber through which the washing water passes is formed in the head and a sterilizer for sterilizing the washing water is provided in the sterilizing chamber.

The beauty-care bidet may further include a skin regenerating laser device for irradiating laser light of reduced output power on a skin of a human body.

ADVANTAGEOUS EFFECTS

With the beauty-care bidet with a vibrator of the present invention, it is possible to wash any part of a human body by hand-holding the device and bringing it close proximity to a target bodily part. Furthermore, the beauty-care bidet can cleanly wash the inside of an intestine or a vagina by inserting a vibratory insertion device into the intestine or the vagina. Moreover, it is possible for the beauty-care bidet to maximize a washing efficiency by applying vibration to washing water.

In addition to the above, the beauty-care bidet of the present invention is capable of washing and massaging a broad area of the human body and stimulating a consumer's buying desire for the device by realizing a massage function of massaging a skin of a human body and a shower function of washing the skin in combination.

BRIEF DESCRIPTION OF THE DRAWINGS

FIG. 1 is an exploded perspective view showing a configuration of a beauty-care bidet with a vibrator in accordance with the present invention.

FIG. 2 is a side elevational section view illustrating the beauty-care bidet with a vibrator in accordance with the present invention.

FIG. 3 is an enlarged section view illustrating a tip operating unit constituting the beauty-care bidet of the present invention.

FIGS. 4 through 6 are sectional views showing modified examples of the tip operating unit constituting the beauty-care bidet of the present invention.

FIG. 7 is a side elevational section view illustrating a beauty-care bidet with a vibrator in accordance with another embodiment of the present invention.

BEST MODE FOR CARRYING OUT THE INVENTION

Preferred embodiments of a beauty-care bidet with a vibrator in accordance with the present invention will now be described in detail with reference to the accompanying drawings.

Referring to FIGS. 1 and 2, a beauty-care bidet of the present invention includes an introduction hose 10 through which washing water can be introduced. The introduction hose 10 is made of a flexurally deformable material, e.g., synthetic resin or rubber. The introduction hose 10 is connected to a tap water pipe (not shown), a connecting hose of a shower device or a water reservoir (not shown) containing warm washing water to introduce tap water, i.e., washing water. In this regard, a pump needs to be used in order to introduce the washing water from the water reservoir.

The beauty-care bidet of the present invention further includes a water purifier 20 connected to the introduction hose 10. The water purifier 20 has a purifier housing 22 within which a purifying chamber 24 is formed. The purifying chamber 24 has an inlet port 24*a* communicating with the introduction hose 10, an outlet port 24*b* through which the washing water is discharged and a filter element 25 received within the purifying chamber 24.

The inlet port 24*a* communicates with the introduction hose 10 and allows the washing water flowing through the introduction hose 10 to be introduced into the purifying chamber 24. A check valve 26 is provided in the inlet port 24*a*.

The washing water introduced into the purifying chamber 24 through the inlet port 24*a* is discharged through the outlet port 24*b* in which a post-treatment filter 30 is installed. The post-treatment filter 30 serves to secondarily purify the washing water which has passed the filter element 25 of the purifying chamber 24.

The filter element 25 is formed of, e.g., a nano silver ceramics ball coated with silver, and is adapted to filter out the washing water passing through the purifying chamber 24 to thereby produce high purity washing water. Although the nano silver ceramics ball is used as the filter element 25 in the present description, the invention is not limited thereto and may employ any type of filter element, such as activated carbon, as far as it has an ability to purify the washing water.

Referring again to FIGS. 1 and 2, the beauty-care bidet of the present invention includes a head 40 coupled to the top portion of the water purifier 20. The head 40 is formed of a lower body 50 and an upper body 60.

The lower body 50 is removably attached to the water purifier 20 by a coupling means which has oppositely extending interlocking protrusions 52 formed on the top surface of the water purifier 20 and interlocking grooves 54 formed on the lower body 50 in such a way as to permit access thereto through an open entrance. The interlocking protrusions 52 are inserted through the open entrance and twisted into engagement with the interlocking grooves 54. Alternatively, a combination of female and male threads may be used as the coupling means.

The upper body 60 is separably coupled to the lower body 50 by means of a joint means which has oppositely extending interlocking protrusions 62 formed on the top surface of the lower body 50 and interlocking grooves 64 formed on the upper body 60 in such a way as to permit access thereto through an open entrance. The interlocking protrusions 62 are inserted through the open entrance and twisted into engagement with the interlocking grooves 64. Alternatively, a combination of female and male threads may be used as the joint means.

On the other hand, the upper body 60 has an open tip end portion 65 to which an adapter 66 is detachably attached. As shown in FIGS. 2 and 3, the adapter 66 has an open introduction chamber 66*a* which in turn is connected to the outlet port 24*b* of the water purifier 20 through a connecting tube 67. Thus, the washing water in the water purifier 20 can be introduced into the introduction chamber 66*a*.

A control valve 68 is installed on the connecting tube 67. The control valve 68 is arranged within the lower body 50 and functions to cut off or pass the washing water supplied from the water purifier 20, while regulating the pressure of the washing water. The control valve 68 has a typical configuration and therefore will not be further described herein.

The upper body 60 is provided with a vibrator 70 arranged on the rear side of the adapter 66 and adapted to generate vibration using the electric power of a battery 72. In this connection, the battery is of a rechargeable type and is charged through a recharging terminal 74 provided on a rear surface of the upper body 60. Alternatively, the battery 72 may be of a replacement type. The vibrator 70 is turned on or off by a switch 70*a* attached to the lower body 50. It is a matter of course that the switch 70*a* is electrically connected to the vibrator 70.

The upper body 60 is provided with a vibration transfer member 75 for transferring vibration of the vibrator 70 to the introduction chamber 66*a* of the adapter 66. The vibration transfer member 75 is connected at one end to the vibrator 70 and extends at the other end into the introduction chamber 66*a* of the adapter 66.

A tip end operating unit 100 is attached to the open tip end portion 65 of the upper body 6. As illustrated in FIGS. 1 through 3, the tip end operating unit 100 is comprised of a bidet-washing insertion device 110.

The bidet-washing insertion device 110 includes a main body 112 detachably attached to the open tip end portion 65 of the upper body 60, an antimicrobial silicon hose 114 that can be extended frontward from the main body 112 and inserted into an intestine or a vagina of a user, and a vibration bar 116 fitted into the antimicrobial silicon hose 114.

The antimicrobial silicon hose 114 is made of an elastically deformable material and has an internal flow passage 114*a* that communicates with the introduction chamber 66*a* of the adapter 66, as can be seen in FIG. 3. In the front portion of the antimicrobial silicon hose 114, there is provided a nozzle head 114*b* that has nozzle holes 114*c* communication with the flow passage 114*a*.

The antimicrobial silicon hose 114 is adapted to spray the washing water introduced via the flow passage 114*a* at the nozzle holes 114*c*. Specifically, the washing water is sprayed in a state that the antimicrobial silicon hose 114 is inserted into the intestine or the vagina of the user.

The main body 112 is detachably attached to the upper body 60 while securely supporting the rear end portion of the antimicrobial silicon hose 114. At this time, the main body 112 supports the rear end portion of the antimicrobial silicon hose 114 through a fixture means and is detachably attached to the upper body 60 by means of an attachment means.

The fixture means includes a fixing ring 112*a* fitted into the internal flow passage 114*a* of the antimicrobial silicon hose 114 and a support member 112*b* for supporting the rear end portion of the antimicrobial silicon hose 114 on the inner surface of the main body 112.

The attachment means includes an interlocking groove 112*c* formed around the open tip end portion 65 of the upper body 60 and an interlocking protrusion 112*d* formed in the main body 112 for releasably engaging with the interlocking groove 112*c*. The main body 112 is separably joined to the upper body 60, while supporting the rear end portion of the antimicrobial silicon hose 114.

The vibration bar 116 is fitted into the flow passage 114*a* of the antimicrobial silicon hose 114. The vibration bar 116 is connected at its rear end portion to the vibrator 70 through the vibration transfer member 75 and has at its front end portion a vibration plate 116*a* of large diameter. In particular, the vibration plate 116*a* is arranged in the nozzle head 114*b* of the antimicrobial silicon hose 114 to vibrate the nozzle head 114*b*. The vibration plate 116*a* has an aperture 116*b* that allows the washing water in the flow passage 114*a* to flow toward the nozzle head 114*b*.

When vibrated by the vibrator 70, the vibration bar 116 generates a wave motion in the washing water flowing along the flow passage 114*a* of the antimicrobial silicon hose 114 and, at the same time, vibrates the nozzle head 114*b* of the antimicrobial silicon hose 114 to thereby maximize a washing effect.

In the meantime, FIG. 4 is a section view showing a modified example of the bidet-washing insertion device 110. With the bidet-washing insertion device 110 of this modified example, an opening 117 is formed in the tip end portion of the nozzle head 114*b* of the antimicrobial silicon hose 114 and a vibration plate 118 of the vibration bar 116 is arranged in the opening 117. The vibration plate 118 has a round outer surface 118*a* that conforms in curvature to the outer surface of the nozzle head 114*b*.

Since the bidet-washing insertion device 110 of this modified example has a configuration that the vibration plate 118 of the vibration bar 116 forms the tip end portion of the nozzle head 114*b*, the vibration bar 116 can apply vibration directly to the body of the user. Not only does this enhances washing efficiency but also provides a massage effect.

If necessary, the vibration plate 118 of the vibration bar 116 may generate ultrasonic vibration, in which case the vibrator 70 for vibrating the vibration plate 118 needs to be formed of an ultrasonic vibrator.

Referring next to FIGS. 5 and 6, there are illustrated another modified examples of the tip end operating unit 100

The tip end operating unit 100 illustrated in FIG. 5 is comprised of a massage device 120. The massage device 120 includes a main body 122 detachably attached to the open tip end portion 65 of the upper body 60, a vibration head 124 movably coupled to a front portion of the main body 122 and a vibration bar 126 for transferring vibration of the vibration transfer member 75 to the vibration bar 126.

The main body 122 is coupled to the open tip end portion 65 of the upper body 60 by means of an attachment means. The attachment means includes an interlocking groove 122*a* formed around the open tip end portion 65 of the upper body 60 and an interlocking protrusion 122*b* formed in the main body 122 for releasable engagement with the interlocking groove 122*a*.

The vibration head 124 is provided on its rear surface with a connecting shaft 124*a* which in turn is movably fitted into an installation hole 122*c* formed in the front portion of the main body 122. Interlocking protrusions 124*b* are formed around the connecting shaft 124*a* and interlocking grooves 122*d* are formed on an inner surface of the installation hole 122*c* for movable engagement with the interlocking protrusions 124*b*.

Meanwhile, a spring 125 is fitted on the connecting shaft 124*a* of the vibration head 124. The spring 125 serves to resiliently bias the connecting shaft 124*a* toward the inside of the main body 122. This allows the vibration head 124 to resiliently move to the left and right relative to the main body 122.

The vibration bar 126 is connected at its rear end portion to the vibration transfer member 75 and coupled at its front end portion to the connecting shaft 124*a* of the vibration head 124. Therefore, the vibration of the vibrator 70 is transferred to the vibration head 124 through the vibration transfer member 75, thus enabling the vibration head 124 to make a vibratory movement.

With the massage device 120 of such a configuration, the vibration head 124 is brought into frictional contact with a skin of a human body or a specified part thereof and then is subjected to a left and right vibratory motion, whereby the skin or the specified part of the of the human body making contact with the vibration head 124 is massaged and corneous tissues of the skin is removed. In case of using the massage device 120, the control valve 68 operates to cut off the washing water otherwise supplied from the water purifier 20.

The massage device 120 further includes a cover 128 capped on the outer surface of the vibration head 124. The cover 128 is made of a non-woven fabric or an antimicrobial material. The non-woven fabric is predominantly used in removing the corneous tissues, while the antimicrobial material is mainly utilized in massaging and stimulating the skin.

Next, the tip end operating unit 100 will be described with reference to FIG. 6. As shown, the tip end operating unit 100 is comprised of a shower device 130. The shower device 130 includes a main body 132 detachably attached to the open tip end portion 65 of the upper body 60 and a spray head 134 integrally formed with the front portion of the main body 132.

The main body 132 is provided with an internal flow passage 132*a* which communicates with the introduction chamber 66*a* of the adapter 66. Therefore, the washing water supplied from the water purifier 20 is introduced into the flow passage 132*a* through the connecting tube 67. The main body 132 is coupled to the open tip end portion 65 of the upper body 60 by means of an attachment means.

The attachment means includes an interlocking groove 132*b* formed around the open tip end portion 65 of the upper body 60 and an interlocking protrusion 132*c* formed in the main body 132 for releasable engagement with the interlocking groove 132*b*.

The spray head 134 has a plurality of spray holes 134*a* communicating with the flow passage 132*a* of the main body 132. The washing water is sprayed frontward through the spray holes 134*a*.

With the shower device 130 described above, it is possible for the user to enjoy a shower using the washing water supplied from the water purifier 20. Particularly, the shower can be taken by use of clean water purified by the water purifier 20.

In case of using the shower device 130, it is desirable to operate the vibrator 70 to thereby ensure that the vibration generated by the vibrator 70 is transferred to the washing water through the vibration transfer member 75. This induces a wave motion in the washing water, thus increasing a washing effect offered by the washing water.

Referring next to FIG. 7, there is shown another embodiment of the beauty-care bidet in accordance with the present invention.

The beauty-care bidet of this embodiment has such a construction that a sterilizing chamber 140 for receiving the washing water from the water purifier 20 is formed in the lower body 50 of the head 40 and a sterilizer 142 for sterilizing the washing water is provided within the sterilizing chamber 140.

The sterilizer 142 may be formed of an ultraviolet sterilizer that irradiates ultraviolet rays into the sterilizing chamber 140 to perform a sterilization treatment for the washing water. The sterilizer 142 may be any type other than the ultraviolet sterilizer and may be arranged in any place as far as the washing water can be sterilized.

With the beauty-care bidet of this embodiment, the purification efficiency can be further increased by purifying and sterilizing the washing water. This enables the user to enjoy bidet washing or a shower with clean water.

The beauty-care bidet of this embodiment further includes a skin regenerating laser device 150 provided in the lower body 50 of the head 40. The skin regenerating laser device 150 is a device that generates laser light of low output power using the electric power of the battery 72, thereby regenerating skin tissues of a human body. For reference, the laser light of low output power helps to expand blood vessels and improve blood circulation, thus effectively regenerating damaged skin tissues into normal ones.

The skin regenerating laser device 150 may be applied to the beauty-care bidet described above with reference to FIGS. 1 and 2. The skin regenerating laser device 150 is turned on or off by a switch 150*a* attached to the lower body 50.

While the invention has been shown and described in respect of preferred embodiments, this is not intended to limit the scope of the invention by no means. It will be understood by those skilled in the art that various changes and modifications may be made without departing from the spirit and scope of the invention as defined in the following claims.

INDUSTRIAL APPLICABILITY

The present invention finds its application in a beauty-care bidet with a vibrator that can be inserted into an intestine or a vagina to wash the inside thereof and also can be used for a beauty care purpose.

The invention claimed is:

1. A beauty-care bidet comprising:
- an introduction hose for introducing washing water;
- a water purifier connected to the introduction hose for purifying the washing water introduced through the introduction hose;
- a head detachably coupled to the water purifier and having an open tip end portion communicating with the water purifier;
- a control valve for cutting off the washing water supplied to the open tip end portion of the head or for regulating a pressure of the washing water;
- a tip end operating unit detachably attached to the open tip end portion of the head; and
- a vibrator mounted to the head in such a way that the vibrator can be operatively connected to the tip end operating unit;
- wherein the tip end operating unit comprises a bidet-washing insertion device, the bidet-washing insertion device including:
  - a main body detachably attached to the open tip end portion of the head;
  - an antimicrobial silicon hose extending frontward from the main body for insertion into an intestine or a vagina of a user, the silicon hose having a flow passage communicating with the open tip end portion of the head and a nozzle head for spraying the washing water introduced into the flow passage; and
  - a vibration bar fitted into the antimicrobial silicon hose to transfer vibration of the vibrator to the antimicrobial silicon hose.

2. The beauty-care bidet as recited in claim 1, further comprising a skin regenerating laser device contained in the head of the bidet for irradiating laser light of reduced output power on a skin of a human body.

3. The beauty-care bidet as recited in claim 1, wherein the vibration bar includes an end vibration plate for vibrating the nozzle head of the antimicrobial silicon hose, the end vibration plate having an aperture through which the washing water in the flow passage flows toward the nozzle head.

4. The beauty-care bidet as recited in claim 1, wherein an opening is formed in a front portion of the nozzle head of the antimicrobial silicon hose and wherein the vibration bar includes a vibration plate arranged in the opening of the antimicrobial silicon hose, the vibration plate has a round outer surface conforming in curvature to an outer surface of the nozzle head.

5. A beauty-care bidet comprising:
- an introduction hose for introducing washing water;
- a water purifier connected to the introduction hose for purifying the washing water introduced through the introduction hose;
- a head detachably coupled to the water purifier and having an open tip end portion communicating with the water purifier;
- a control valve for cutting off the washing water supplied to the open tip end portion of the head or for regulating a pressure of the washing water;
- a tip end operating unit detachably attached to the open tip end portion of the head; and
- a vibrator mounted to the head in such a way that the vibrator can be operatively connected to the tip end operating unit;
- wherein the tip end operating unit comprises a massage device, the massage device including:
  - a main body detachably attached to the open tip end portion of the head;
  - a vibration head movably provided in a front portion of the main body; and
  - a vibration bar for transferring vibration of the vibrator to the vibration head.

6. The beauty-care bidet as recited in claim 5, further comprising a cover capped on an outer surface of the vibration head, the cover made of one of a non-woven fabric and an antimicrobial material.

7. The beauty-care bidet as recited in claim 5, further comprising a skin regenerating laser device contained in the head of the bidet for irradiating laser light of reduced output power on a skin of a human body.

8. A beauty-care bidet comprising:
- an introduction hose for introducing washing water;
- a water purifier connected to the introduction hose for purifying the washing water introduced through the introduction hose;
- a head detachably coupled to the water purifier and having an open tip end portion communicating with the water purifier;
- a control valve for cutting off the washing water supplied to the open tip end portion of the head or for regulating a pressure of the washing water;
- a tip end operating unit detachably attached to the open tip end portion of the head; and a vibrator mounted to the head in such a way that the vibrator can be operatively connected to the tip end operating unit;

wherein the head includes a sterilizing chamber through which the washing water passes, and an ultraviolet sterilizer which irradiates ultraviolet rays into the sterilizer chamber for sterilizing the washing water.

9. The beauty-care bidet as recited in claim 8, further comprising a skin regenerating laser device contained in the head of the bidet for irradiating laser light of reduced output power on a skin of a human body.

* * * * *